United States Patent [19]

Yacoboni

[11] 4,133,150

[45] Jan. 9, 1979

[54] DOME AND SEMI-DOME-SHAPED STRUCTURE

[76] Inventor: Joseph Yacoboni, Rte. 5, Box 409, Lake Placid, Fla. 33852

[21] Appl. No.: 850,950

[22] Filed: Nov. 14, 1977

[51] Int. Cl.[2] ..... E04B 1/32

[52] U.S. Cl. ..... 52/80; 52/82; 237/1 A; 126/271

[58] Field of Search ..... 52/80, 81, 82, 86, 65; 237/1A; 126/270, 271

[56] References Cited

U.S. PATENT DOCUMENTS

| | | | |
|---|---|---|---|
| 1,841,321 | 1/1932 | Arnstein | 52/65 |
| 2,449,478 | 3/1950 | Feser | 52/81 |
| 2,768,432 | 10/1956 | Hines | 52/81 |
| 3,075,762 | 1/1963 | Ahrens | 52/80 |
| 3,091,056 | 5/1963 | Porte | 52/65 |
| 3,186,522 | 6/1965 | McCauley | 52/81 |
| 3,417,520 | 12/1968 | Fink | 52/80 |
| 3,562,975 | 2/1971 | Moss | 52/80 |
| 3,894,367 | 7/1975 | Yacoboni | 52/80 |
| 3,973,364 | 8/1976 | Seaman | 52/80 |
| 4,004,574 | 1/1977 | Barr | 237/1 |

FOREIGN PATENT DOCUMENTS

| | | | |
|---|---|---|---|
| 290468 | 2/1916 | Fed. Rep. of Germany | 52/65 |

*Primary Examiner*—Ernest R. Purser
*Assistant Examiner*—Henry Raduazo
*Attorney, Agent, or Firm*—George B. Oujevolk

[57] ABSTRACT

A semi-dome-shaped structure has a foundation and a plurality of load-bearing structural elements each of which extends upwardly from the base and meets at a common vertex suspended above the base. Each structural element has a longitudinal centerline that lies approximately within intersecting great circle planes whose line of intersection is perpendicular to the base. A top covering extends over the structural elements from the vertex of the structural elements to a small semi-circle intermediate the vertex and the base. A plurality of side panels extend from the top covering to the base to provide an enclosure. The front of the structure can have an enormous picture window and a balcony.

6 Claims, 28 Drawing Figures

FIG. 17
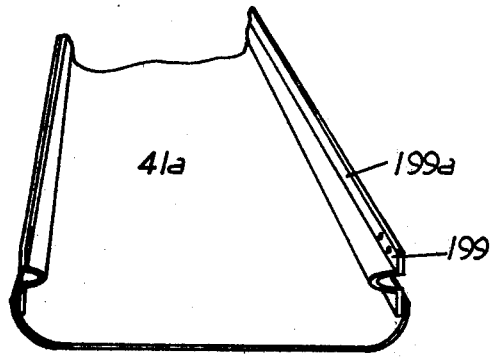
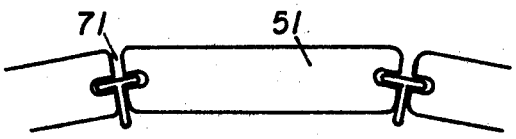
FIG. 17a
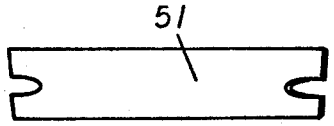
FIG. 17b
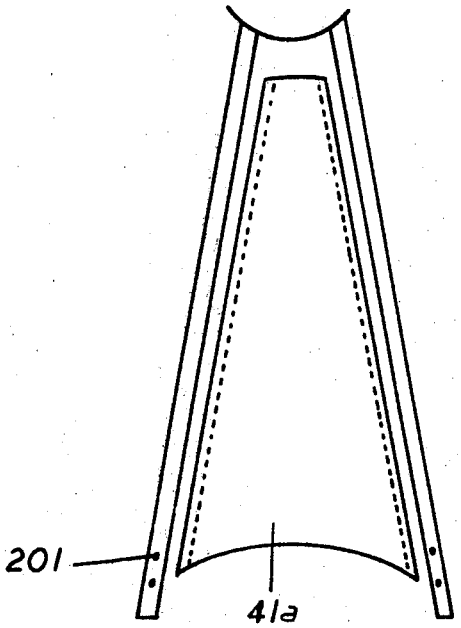
FIG. 17c

DOME AND SEMI-DOME-SHAPED STRUCTURE

BACKGROUND OF THE INVENTION

This invention relates to a housing structure having a generally dome or semi-dome-shaped exterior configuration and to a method for building the same.

BRIEF REVIEW OF THE PROBLEM

The provision of adequate housing facilities for modern man is and has always been a perplexing and expensive problem. The costs of labor and of material prevent low-income families from obtaining adequate housing. Consequently, such families are forced to tolerate and to live in the squalor and filth of ghetto districts.

In an effort to solve the absence of satisfactory housing facilities, modern man has razed ghetto buildings whereupon low income families are forced to move on in search of new dwellings and to await the reconstruction of a sterile, impersonal, high-rise apartment complex. Unfortunately, the interim period of wait is long, unnecessary delay requiring many months before the first family can return to its remodeled district.

The bigger the high-rise apartment complex the longer its construction time and the longer a family is deprived of adequate housing. Also, there are attendant labor costs and production hours interspersed with labor difficulties which contribute to the spiraling construction costs.

There has been a long-felt need for economic and commodious housing facilities for low-income families. Such facilities must be commodious and accommodate an average-sized family. The structure and architecture of such facilities must be pleasing and have some esthetic value and inherent beauty. The structure should be sturdy and relatively easy to construct with low-cost but adequate building materials. The time required to construct such facilities should be very short such that the delay of transferring families is minimal. Each family unit should be isolated so that each family has some degree of privacy, of independence and of individuality.

In my previous U.S. Pat. No. 3,894,367, I have generally provided an answer to these long-felt needs. This present invention is an improvement over some of the features of the aforementioned patent. I have, again, discovered a novel dome-shaped structure which fulfills these needs and have developed a novel method of erecting such a structure within a greatly reduced period of time as compared to the time needed to build conventional structures. The design of my structure is flexible and it may be adapted to meet a wide range of floor space requirements and the like depending upon the various circumstances. It has a configuration which is inherently beautiful and pleasing and through inexpensive landscaping techniques it naturally blends in with the surrounding environment without intruding upon the natural beauty of the environment.

While my invention is substantial contribution to the housing needs of modern man, particularly low-income families, it is also adaptable for use in other more affluent contexts. For example, my novel structure may be desired as a second home.

SUMMARY OF THE INVENTION

In accordance with one aspect of the invention, a semi-dome-shaped building comprises a semi-circular base and a plurality of load-bearing structural elements. Each structural element extends upwardly from the base and meets at a common vertex suspended above the base. At the front of the structure is an enormous flat semi-circular picture window and a balcony extending outwards therefrom. Each structural element has longitudinal centerlines that lie approximately in intersecting great circle planes whose line of intersection is substantially perpendicular to the base. A top covering extends over the structural elements from the vertex to a small circle that is intermediate the vertex and the base. A side covering extends from the top covering to the base.

According to another aspect of the invention the structure herein contemplated can be rapidly assembled on the construction site and the building components required can be made on the spot.

The invention as well as other objects and advantages thereof will become more apparent from the following detailed description when taken together with the accompanying drawing, in which:

BRIEF DESCRIPTION OF THE DRAWINGS

In the drawings:

FIGS. 17, 17*a*, 17*b* and 17*c* present in section and in perspective a method of assembling using the molding arrangement of FIGS. 16 and 16*a*;

FIG. 18 and FIG. 18*a* show further assembly and construction details in perspective;

DETAILED DESCRIPTION

The Overall Structure

Figure 1:
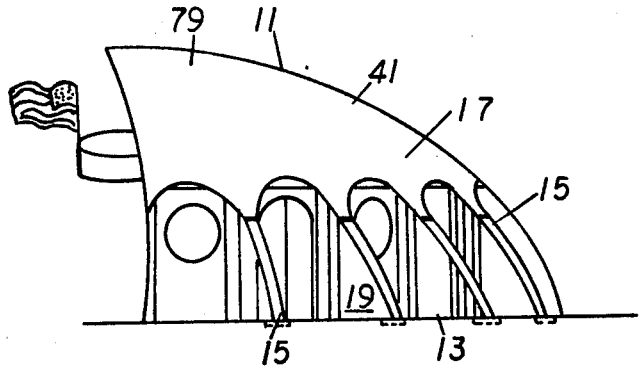
FIG. 1 is a side-elevational view of an embodiment of the housing structure made in accordance with the invention.
Figure 2:
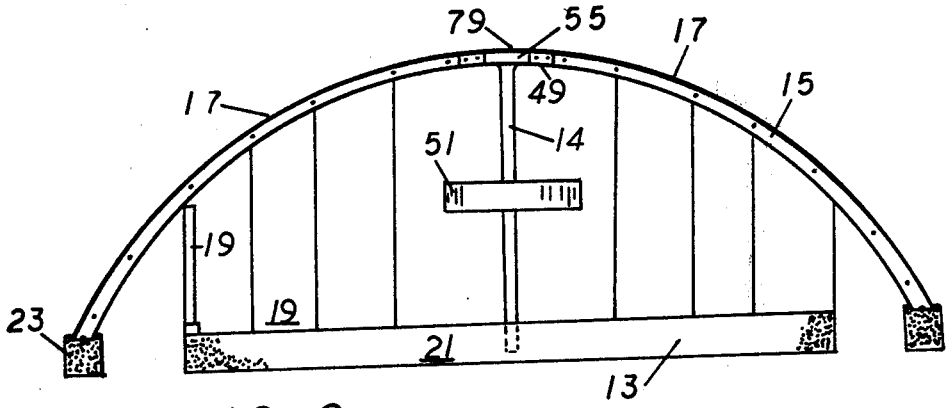
FIG. 2 is a schematic, front elevational view of the housing structure of FIG. 1.

In accordance with the invention as shown in FIGS. 1 and 2 the housing structure 11 has a base 13, a central support pole 14, a plurality of structural elements or ribs 15, a top covering or roof deck 17 and a plurality of side panels 19.

The base 13, as shown in FIG. 2, comprises an inner concrete slab 21 resting on the earth as a foundation and front and supporting side panels 19 and concrete piers disposed in an annulus resting on the earth as a foundation and supporting the structural elements 15. The concrete slab 21 has a semi-circular configuration. The concrete piers 23 have a semi-ring-like configuration and are concentric with the first slab 21. The depth to which both of the concrete slabs 21 and piers 23 illustrated herein extend into the earth will depend upon the building code requirements of local municipalities.

The outer concrete piers are so arranged that all of the structural elements 15 are connected to the piers and thereby provide an integral structure. Thus, individual foundation pilings for each structural element 15 are used with tie bars 45*a*,45*b*, extending between pilings to provide an interconnected structure.

Each of the structural elements 15 extend upwardly from concrete pier 23 and meet at a common vertex or locus that is suspended above the base 13 as shown in FIG. 2.

Figure 3:
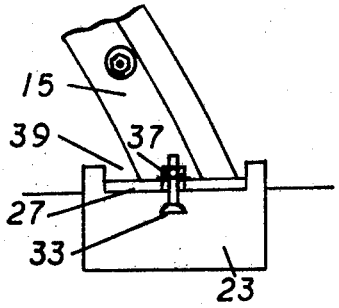
FIG. 3 is an expanded side elevational view of one of the structural elements of FIG. 2 and its connection to a pier of the housing structure.
Figure 4:
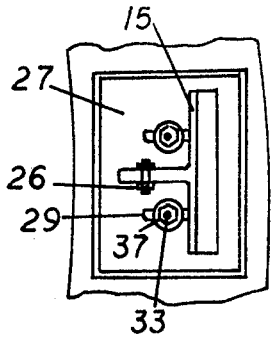
FIG. 4 is a top planar view of the structional element of FIG. 3.
Figure 6:
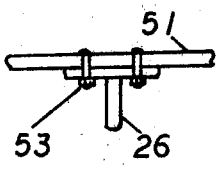
FIG. 6 is a cross-sectional view of a portion of the housing structure of FIG. 1 showing the support arrangement.
Figure 6A:
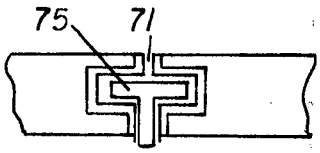
FIG. 6*a* is a sectional view of another support arrangement.

The cross-sectional configuration of the structural elements 15 of FIG. 1 is T-shaped as seen more clearly in FIG. 6. The structural elements 15 illustrated herein are composed of structural steel and are fixed to the concrete piers 23. One end of the structural element 15 terminates at a steel base plate 27 as shown in FIG. 3. The steel plate 27 is metallurgically bolted to the end of the structural element 15. As shown in FIG. 4 the base plate 27 is fixed to each structural member 15. Each plate 27 has an elongate aperture or slot 29 as shown in FIGS. 3 and 4. Anchoring bolts 33 or the like are embedded in concrete pier 23 and each anchoring bolt 33 extends upwardly through the elongated aperture 29 and terminates above the base plate 27. A conventional washer 35 and nut 37 secure the base plate 27, and, consequently, the structural element 15 to pier 23.

The base plate 27 is disposed into recess 39 of pier 23 as shown in FIG. 3. The recess 39 has linear dimensions that conform generally to the dimensions of the base plate 27. The recesses 39 are a desirable feature of my invention as grout or the like may be disposed into the remaining unfilled portion of recess 39 to provide a neat appearance of the fixture of the structural elements 15 to the base 13 of the housing structure.

Each of the structural elements 15 are structural, load-bearing members and together with the pier 23 they support the entire weight of the housing. Each structural element 15 has a longitudinal centerline that lies approximately in great circle planes that intersect each other at the common line of intersection which is substantially perpendicular to the base 13 as shown in FIG. 2. Herein the expression "great circle plane" refers to those geometric planes that pass through the center of a common sphere. The structural elements illustrated herein are also substantially on great circle arcs that are formed by the great circle planes intersecting a common sphere.

The total number of structural elements 15 used in the practice of the invention will depend upon engineering requirements of the particular size of the structure.

Figure 7:
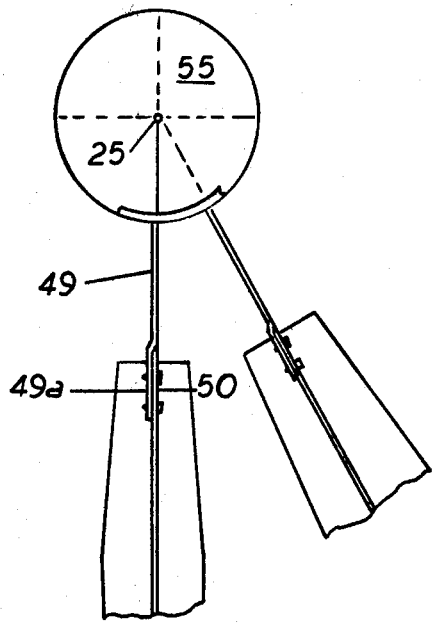
FIG. 7 is a top planar explanation of the common vertex of the structural elements.

The top covering or roof deck 17 extends over the structural elements 15 from their common vertex 25 to a hub 26 circle that is intermediate the vertex 25 and the base 13 as shown in FIG. 7. Herein the expression "small circle" refers to the geometric plane intersecting a common sphere that is parallel to the base 13 and that does not pass through the center of the common sphere. The distance that the top covering 17 extends downward from the vertex 25 and terminates above the base 13 is a matter of choice, economics and styling.

In practice, the structure 11 is formed of a plurality of prefabricated roof segments 41. Each roof segment 41 comprises a structural beam 15 which has a T-shaped configuration, at least two cross-ribs 45*a*,45*b*, a terminal member 49 fastened to the beam and a segment 41 extending thereover and forming a part of the top covering 17. The beams, cross-ribs and terminal members are metallurgically bolted together to provide a sturdy roof segment. The segment 41 is secured to the various structural elements of the roof segment with fastener 53 of the like as shown in FIG. 6. If desired, a caulking compound or the like is disposed between segment 41 and underlying structural elements of the roof segment 41 for providing weatherproofing. Terminal member 49 includes an inner end coupling piece 49*a* which is fastened to an end section 50 of beam 15 bent in such a manner that terminal member 49 and the vertical leg of beam 50 lie in one plane.

The members or beams and cross-ribs 45*a*, 45*b* define a tapered dove-tailed surface conforming substantially to a spherical segment. As is well-known a membrane, such as the segment 41 of FIG. 5, tends to buckle at relatively low compressive loads and lose its structural effectiveness before it can be of any use. This problem becomes more acute as the compressive loads on the curved membrane increases. Thus, the use of cross-ribs 45*a*,45*b* provides considerable reinforcing strength to the segment 41 which is a desirable feature of the invention.

Figure 5:
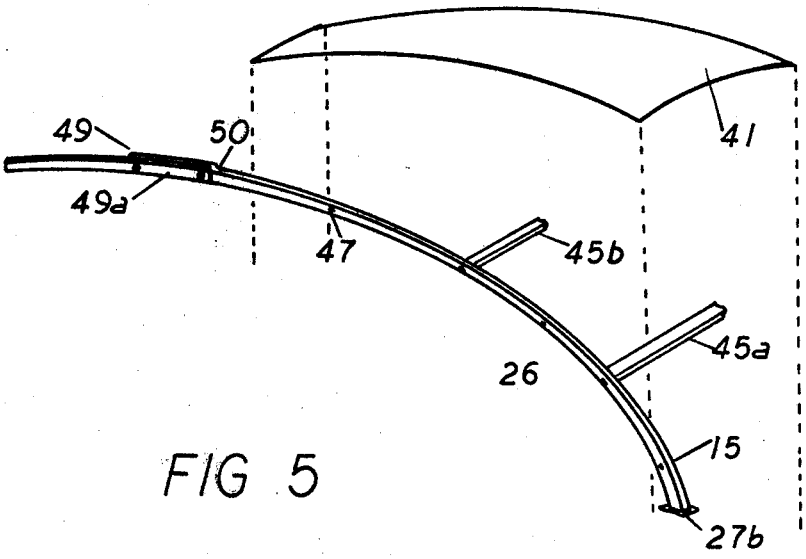
FIG. 5 is an exploded, isolated view of a segment of the roof of the housing structure of FIG. 1.

The roof segments 41 of FIG. 5 when placed edge to edge form the dome-shaped structure 11 of FIG. 1. To this end the common vertex 25 comprises a hub 55 as shown in FIG. 7 to which each of the terminal members 49 for the roof segments 41 is connected. Conventional fasteners 63 secure each terminal 49 for the roof segment 41 to each respective beam 15, as hereinbefore described.

Each beam 15 of the roof segment 41 as shown in FIG. 5 has a plurality of apertures 47 that are spaced apart at equal intervals therealong. Thus fasteners 26 or the like extend through these apertures 47 for securely fastening one beam of an adjacent roof segment, as shown in FIGS. 3–6 and to the terminal member 49.

Figure 16:
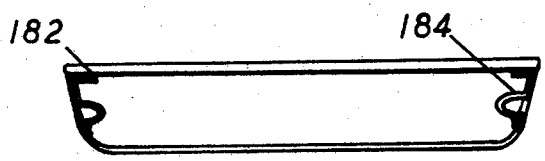
FIGS. 16, 16*a*, 16*b* illustrate another feature of the molding arrangement.
Figure 16A:
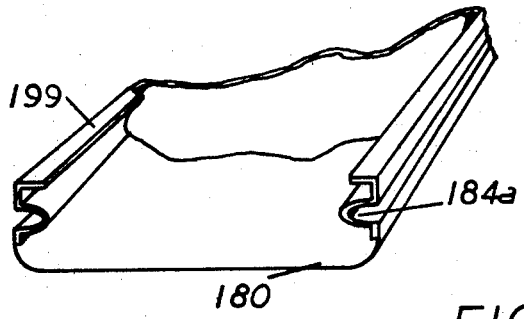

The roof segments 41 of FIG. 5 when placed edge to edge form a resulting joint or seam 71. The outer edges of the panel 51 are grooved as shown in FIGS. 16 and 17*a* at 73 and tongue holding means 75 are disposed into the joint or seam 71 to seal the same. The entire roof of the structure 11 of FIG. 1 is completely weatherproof.

In a preferred embodiment of the invention there are 11 of the roofing segments 41 forming the structure 17 of FIG. 1 wherein each of the beams 15 of each roof segment 41 subtends an 18° angle.

In FIG. 6 the panel 51 is made of fiberglass. The useful materials for use in the practice of the invention as rigid foams also include polyurethane resins, vinyl resins such as polyvinyl chloride, copolymers of polyvinyl chloride, and polyvinyl acetate, polystyrene resins and copolymers thereof, epoxy resins, phenolic resins such as phenol formaldehyde, polyethylene resins, acrylic resins, synthetic rubbers and the like.

The thickness of the rigid foam will vary over a wide range of limits and will depend upon the environment to which the top covering is subjected, the density of the foam, the nature of the synthetic polymeric material forming the foam and the insulation requirements of the particular application. Generally, the thickness of the rigid foam for most applications will be within the range of ½ to about 4 inches or more.

As illustrated in FIG. 2 a roofing cap 79 is disposed over the terminal members 49 of the roof segment 41 and the hub 55. The roofing cap 79 has a generally circular configuration and is composed of the same type of materials as the panel 51 hereinbefore described. The roofing cap 79 has a tape (not shown) or the like extending over the joint formed by roofing cap 79 and the roof deck 17 to render the house completely weatherproof.

The side panels 19 of FIG. 1 extend from the top covering or roof deck 17 to the base 13 and form an enclosure defining the interior of the dome-shaped house 11. As illustrated herein each panel 19 corresponds to each roof segment 41 and extends between structural elements 15. In the preferred embodiment of the invention each side-panel corresponds to its respective roof segment 41. It will be recognized, however, that more or less side panels could be used in the practice of the invention.

Figure 8:
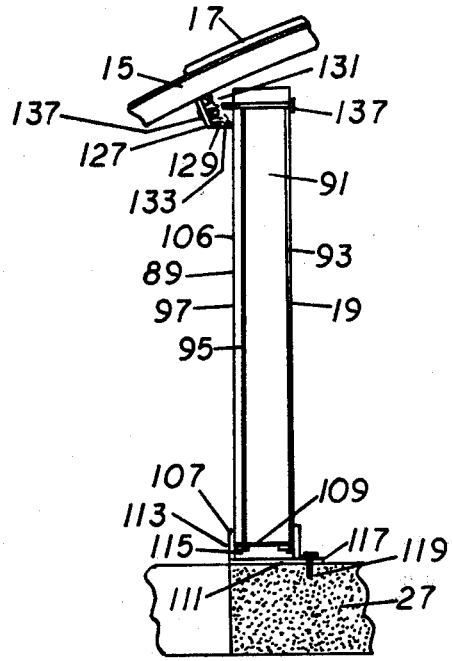
FIG. 8 is an expanded, cross-sectional view of a side panel of the housing structure of FIG. 1.

Each side panel 19 as illustrated in FIG. 8 is a planar laminate comprising an outer layer 89 of an impervious weatherproof substance, an intermediate layer 91 of an insulating material and an inner layer 93. Preferably, the outer layer 89 consists of an asbesto material 95 having a facing 97 composed of a thermoplastic material on its exterior for exposure to the environment. Such outer layer materials are readily commercially available. The thickness of such a layer is generally about one-eighth of an inch.

The intermediate layer 91 consists preferably of a rigid foam of a synthetic polymeric material of the classes previously described which have low density and low heat transmission characteristics.

The inner layer 93 consists of an asbestos-type material which forms the facing for the interior of the house 11 in the preferred embodiment of the invention. Such a surface may be painted or covered with conventional wallpaper as desired to achieve the particular interior aesthetic as desired. The three layers of materials heretofore described are preferably chemically bonded together with an adhesive such as rubber cement. Such adhesives are readily commercially available.

The side panels 19 herein are preferably a prefabricated unit of a predetermined size. However, it should be observed that the side panels 19 are not structural members but that the structural elements 15 are the main load-bearing members of the dome-shaped house 11 of this invention. This is a desirable feature of my invention, as the side panels 19 not being load-bearing members may then be removed and reinstalled as desired without affecting the structural integrity of the housing structure 11 of this invention.

Side panels 19 include windows, doorways, and other openings and the like. Such openings are provided in the side panels in a conventional manner.

Figure 9:
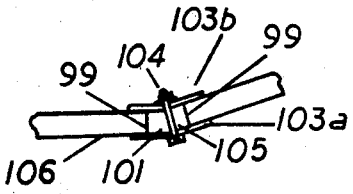
FIG. 9 is an expanded, top-planar view of two adjacent side panels of the housing structure of FIG. 1.

In FIG. 9 the side panels 19 when placed edge to edge form joints 101 which are splined together with splines **103*a* and 103*b* as shown in FIG. 9. The splines 103*a* and 103*b* are thin elongate metallic strips that cover the joints 101 and that extend from the top to the bottom of the side panels 19. Fasteners or the like 104 at spaced apart intervals along the length of the splines urge the splines tightly against the side panel faces 106 to provide a weatherproof joint. Between the edges 99 of each panel there is disposed an insulating material 105** which is preferably composed of a mineral rock wood substance. Such materials are readily commercially available.

In FIG. 8 side panel 19 is secured to the base 13 by base plate 107. The base plate 107 is disposed between the base 13 and the bottom edge 109 of the side panel 87. The base plate 107 comprises a bottom face 111, opposite side faces 113 meeting the bottom face to form a channel that receives the bottom edge 109 of the side panel 19. The side faces 113 have diametrically opposed lips 115 that extend inwardly of the channel and run along the length of the channel to form a ledge upon which the bottom edge 109 of the panels rest. The base plate 107 includes flanges 117 that extend laterally from the bottom face 111 of the base plate 107 which are used for securing the base plate 107 to the base 13. Preferably the base plate is composed of a structural steel. Bolts 119 and the like secure the flanges and the base plate 107 to the base as shown in FIG. 8.

In FIG. 8 the panel 19 is secured to structural elements with a top plate 127 and an intermediate fixing member 129. The top plate 127 comprises a planar piece of steel which extends from adjacent structural elements and is welded thereto. The top plate 127 of FIG. 8 lies in a plane that is substantially perpendicular to a tangent of the great circle arc in which the structural element 15 lies. The intermediate fixing member 129 is preferably composed of a 2 inch × 4 inch wooden beam that has been longitudinally cut into two beams on a bias whereupon a trapezoidal cross-sectional configuration is provided as shown in FIG. 8. The intermediate member 129 has a face 131 engaging the top plate 127 and has another face 133 engaging the exterior face 106 of the panel 19. Fasteners 137 secure the intermediate fixing member 129 to the top plate and also fix the upper edge of the panel 19 to the fixing member 129 as shown in FIG. 8. It will be readily apparent to those skilled in the art that other techniques for fastening side panel 19 to base 13 and elements 15 are available.

When constructing the structure 11 of FIG. 1, the base 13 is formed including the first inner concrete slab 21 and the second outer concrete slab 23 as hereinbefore described.

Figure 10:
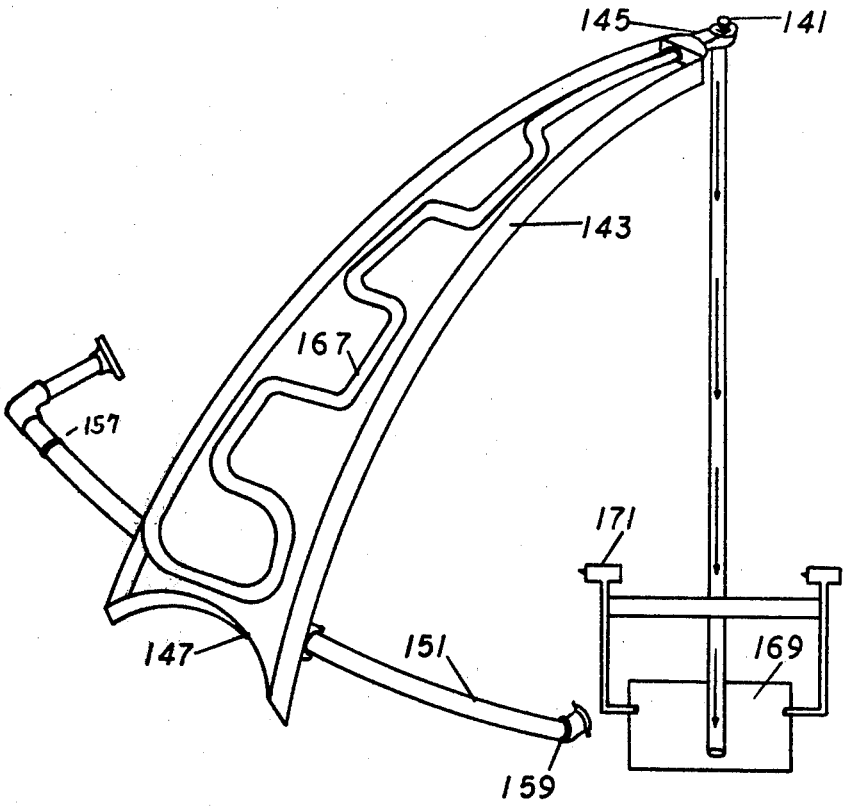
FIG. 10 illustrates a solar all energy panel in perspective.
Figure 11:
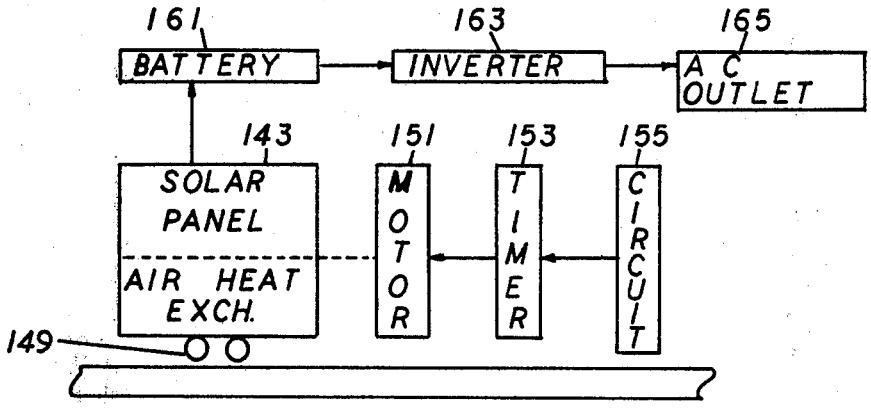
FIG. 11 is a schematic explanation of the operation of the panel shown in FIG. 10.

The circular hub 55 is placed on and in the center of the diameter of the first slab 21. Roof segments 41 are placed on the base 13, and the terminal members 49 of each segment 15 are loosely fitted to the respective spokes 57 of the hub 55 as shown in FIG. 10. A crane or the like raises or hoists the hub and the loosely fixed roof segments 41 until each base of the structural members 15 slide into engagement with the recesses 39 and the anchor bolts 33. The terminal members 49 pivot about spoke 57 as the hub 55 is raised by the crane. The base plate 27 of each structural member 15 is then secured to the anchoring bolts 33 and then, the terminal members 49 of the roof segments 41 are securely fixed to the spokes 57 of the hub 55. The structure assumes configuration which is stable and sturdy. Subsequently the other roof segments 41 are individually lifted with a crane and secured to the hub 55 and the base 13. The abutting side beams 15 of the roof segment 41 are bolted together to form the structural elements.

Subsequently, the roofing cap 79 is placed at the apex of the structure over the hub 55 and the terminal members 49 as previously described and secured into place. The joints 71 between the roof segments are filled with the insulating material 75 and a covering tape 77 is disposed over the roof and to provide a weatherproof roof.

Figure 1A:
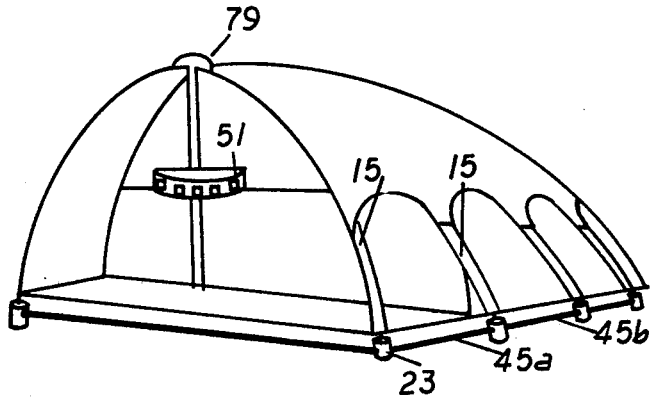
FIG. 1*a* is a perspective view of the structure shown in FIG. 1.

Subsequently, the side panels 19 are installed, each panel being disposed in alignment with each of the roof segments 65 and splined together as to provide a completely closed structure. At the front of the structure a balcony 51 can be placed over the face of the semi-dome. Additionally, it is advantageous to have two additional outer roof segments 15' as shown in FIG. 1*a*.

THE SOLAR HEATING SYSTEM

As shown in FIG. 10, the dome or semi-dome-shaped structure is heated by solar energy. Attached to the central support pole 14 is a trailer hitch 141 similar to the device attached to a vehicle to hitch a trailer. Extending outward from the trailer hitch is a solar panel 143. This solar panel is similar in appearance to panels 51 and having a tie rod 145 to tie the solar panel 143 to the trailer hitch 141. The panel 141 is generally of a tapered configuration having a wide bottom section with a curve 147 along the bottom edge to blend with the symmetry of the structure. The panel 143 itself is curved to conform to the curvature of the dome. The panel is made of flexible glass designed to concentrate the sun heat into the panel. At the base of the panel is a roller arrangement 149. Around the outer perimeter of the semi-dome is an anchor rail 151 for the panel. This anchor rail 151 defines the travel path of the panel. The roller arrangement 149 rides on the anchor rail. The rail inclines slightly and if allowed to fall freely the panel would roll back to the bottom of the incline. The panel roller arrangement 149 has a motor 151, a timer 153 and a circuit 155. The motor 151 controlled by the timer 153 slowly drives the panel up the rail 151. When the panel reaches the top of the incline it trips a switch 157. This switch 157 is coupled to the circuit 155. The circuit is opened, the motor ceases to power the roller arrangement and the panel slowly travels back down the incline where it trips a second switch 159 which enables the motor circuit 155. The motor 151 then again drives the panel up the incline. The panel has solar batteries 161 which are charged by the solar heat and store the electricity. The stored electricity is converted to A-C current by an inverter 163 and fed to an A-C outlet 165. Additionally, the panel has a hot air heat exchanger system 167. Air is circulated through pipes in the panel and stored in a storage chamber 169. The hot air is then fed to the structure through controlled outlets 171.

CONSTRUCTION OF THE STRUCTURE

Figure 12:
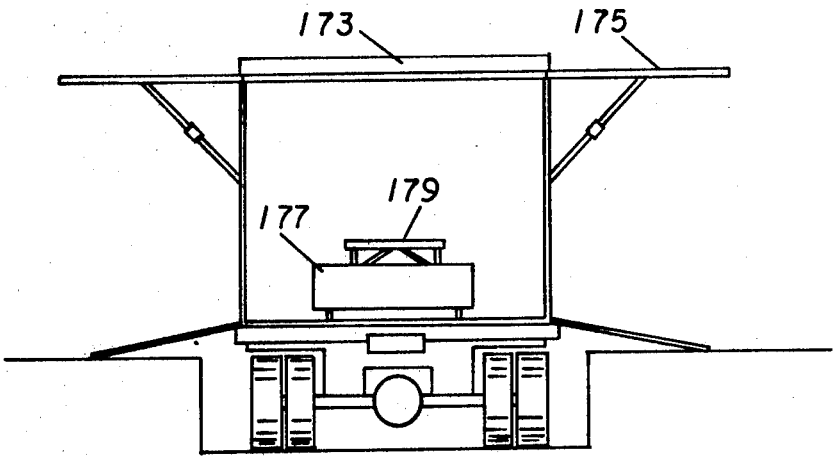
FIG. 12 depicts in schematic form how molds are carried.
Figure 13:
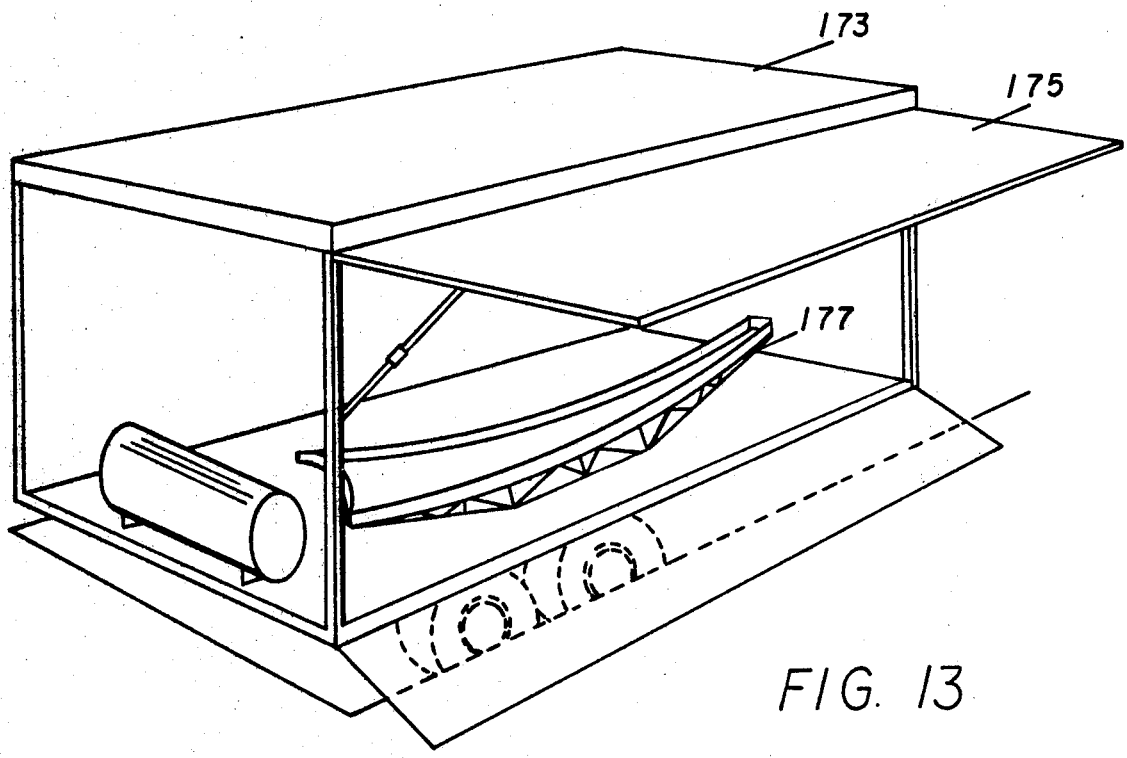
FIG. 13 shows a perspective view of a mold transported as shown in FIG. 14.
Figure 14:
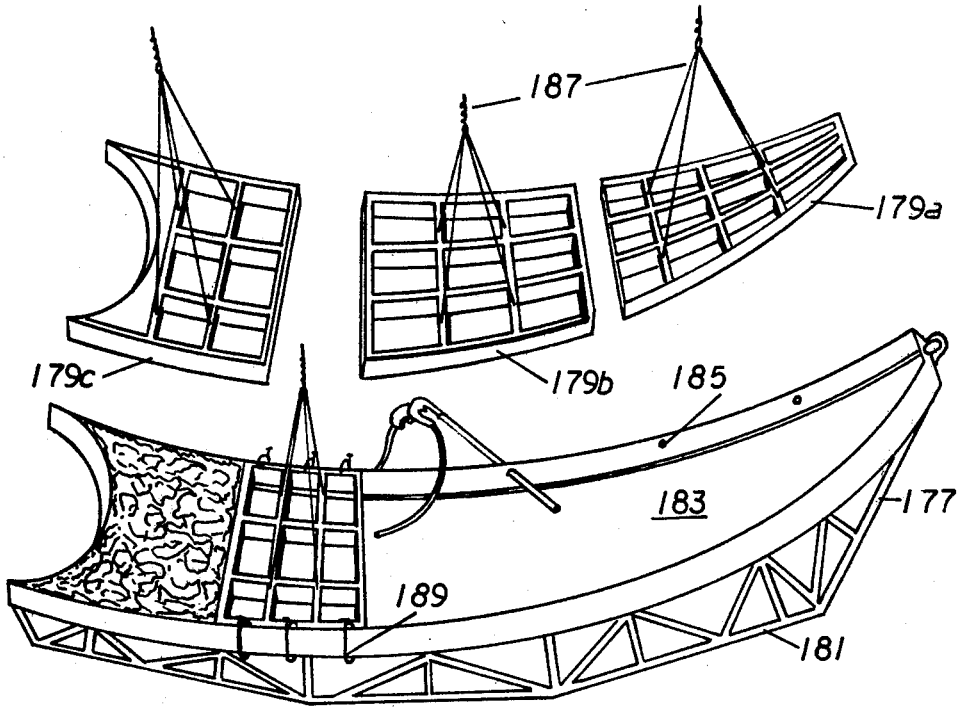
FIG. 14 illustrates in perspective one type of molding operation contemplated.

The structure contemplated herein lends itself to on-site fabrication of components. As shown in FIGS. 12 and 13, a truck trailer 173 with open side panels 175 carries the mold compressor 177 and mold top 179. The mold is about 22 feet long and readily fits in a 45 foot trailer. Two systems of molding are possible; the open mold shown in FIGS. 14, 14*a* and 14*b* and the closed mold of FIG. 15. Various agencies have at times objected to fiberglass panels stating that voids are sometimes caused in fiberglass construction. To satisfy such agencies, the open mold is preferable since they can then see what takes place. The mold bottom 177 is generally a vessel shaped to define a panel. When mounted in a trailer, it is formly fastened to the floor of the trailer. The mold bottom 177 includes a support 181 and a form vessel 183. The form has side apertures 185. If the open mold is used as shown in FIG. 14, the individual top portions of the mold are attached to the ceiling of the trailer by a cord and spring arrangement 187. As shown in FIG. 14, the top portion has three sections 179*a*, 179*b* and 179*c*. These are fastened to the bottom vessel 183 by clamps 189. The foam can be shot in from the side apertures 185 or from the top with a foam gun. The use of several top sections permits exposing the foam for quality control.

Figure 15:
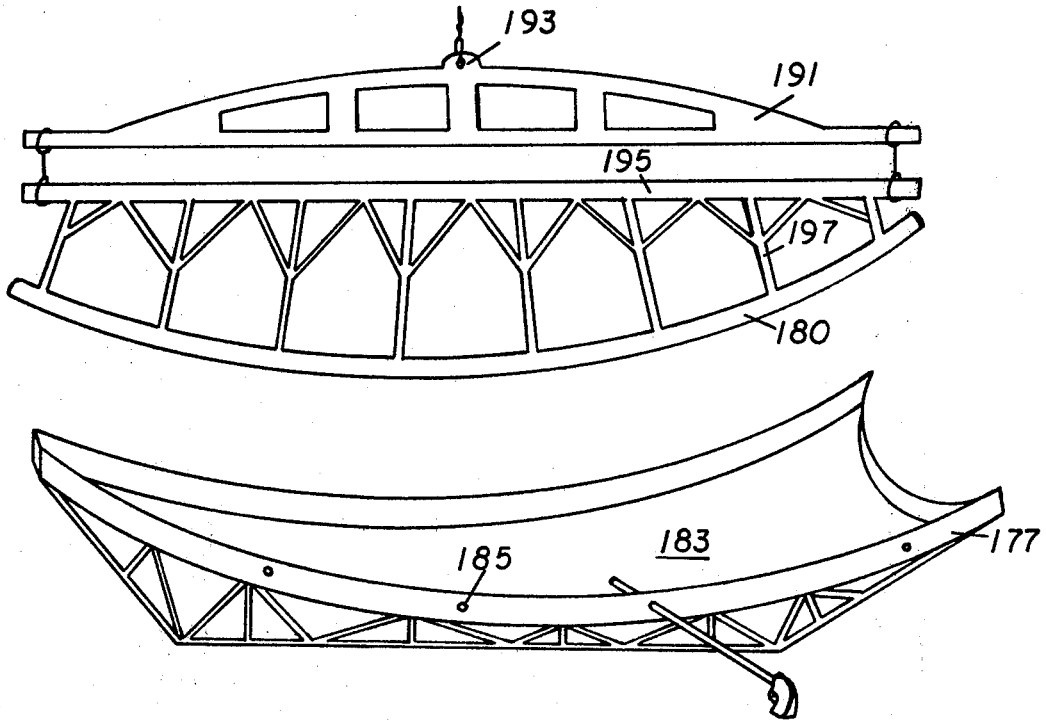
FIG. 15 illustrates in section and perspective another type of molding operation.
Figure 16B:
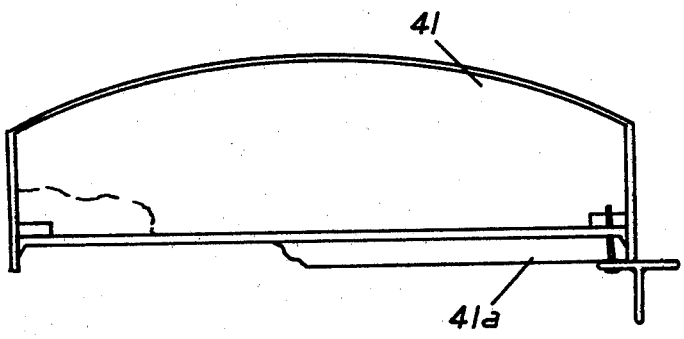

Nevertheless, for certain applications a one-unit top may be used. In this case as shown in FIG. 15, the bottom vessel 183 is as in FIG. 14 but the top 180 is in one piece. The top 180 is held by a lever 191 held in turn by a crane hoist 193. The lever 191 has end fastening means which are coupled to a bar 195. This bar 195 has legs 197 which hold the mold top 180. The top 180 is set over the form vessel 183 and froth foam is shot in from side holes 185. This arrangement can likewise be mounted in a trailer. To facilitate the joining of adjacent roof segments, a tongue and groove arrangement may be used. Although this may consist of one side of the segment having a groove while the other side has a tongue, in practice it is best if all roof segments have grooves as shown in FIG. 16. Here the mold vessel 182 has grooves 184 on each side. The foam froth forms around the groove 184 and produces the corresponding groove 184*a* on the finished workpiece. This tongue and groove arrangement is useful for both the roof segments 41*a* and side panels. The side panels being made in a manner similar to the roof panels. The use of this construction is illustrated in FIGS. 17, 17*a*, 17*b* and 17*c*. Steel rails 199 about 21 feet long are attached to the roof segments. These rails are U-shaped so as to enter the groove 84 and have an overhanging plastic or steel flange 199*a* to ride over the roof segment. The molded segments themselves are about 4 inches in thickness. When using these segments with grooves, the T-beams 15 do not go under the panel as shown in FIG. 6, but fit into the grooves 184*b* of the steel rails 199. Holding the roof segments further to the T-beams are fastening means 201, e.g., nuts and bolts passing through the flange and the side of the roof segment. A liquid rubber coating is poured over the roof to fill in cracks. Foam is used on roof segment 41 as a thermal barrier for insulation (FIG. 16*b*).

OTHER FEATURES

Figure 18:
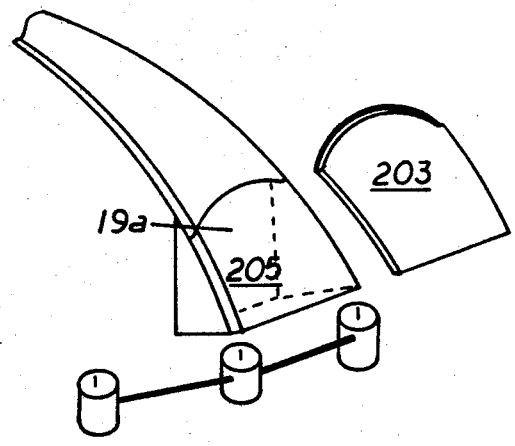
Figure 19:
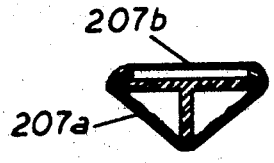
FIG. 19 illustrates the use of cold weather structural components.
Figure 20:
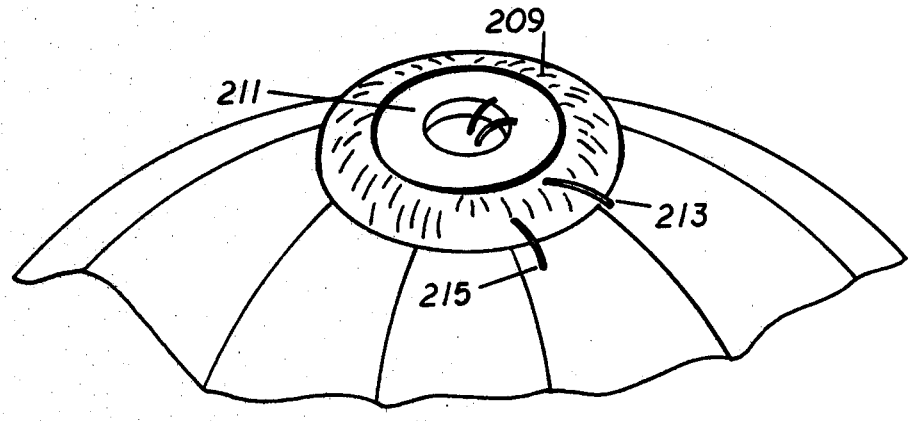
FIG. 20 shows an optional water heater arrangement.

As shown in FIG. 18, the space between the side panels and the T-beams 15 can be moved into closets. A roof extension panel 203 is fitted between the roof segments and the piers 23. A floor 205 is laid and the side panel 19 is replaced by a louvered folding door 19*a*. Indeed the inside panel 19 can be retained and the roof extension panel can be made into a door so that an outside closet is built.

A desireable feature for cold climates is to have a fiberglass jacket 207*a*, 207*b* around the T-beams. This jacket is in two parts. A U-shaped bottom 207*a* with inward flanges to grip the outer extremeties of the T-beam and a cover 207*b* with inner flanges to slip over the U-shaped bottom. This jacket will prevent frost from creeping into the house along the beam. Another useful expedient is to have a block tractor inner tube 209 over the apex of the dome. The tube 209 with a one-half inch plate glass cover 211 will store water. The tube is fitted with inflow and outflow lines 213, 215.

I claim:

1. A structure having:

(a) a plurality of piers (23) disposed in a substantially semi-annular configuration with a defined diameter;

(b) a central vertical pole roof support (14) at the center of said defined diameter with a defined top portion;

(c) a semi-circular disk-like foundation (13) within and concentric with said semi-annular configuration;

(d) a concave hub (55) disposed over and held by said roof support (14);

(e) a plurality of arcuate ribs (15) having a T-shape cross section, each rib (15) having an elongated arcuate member disposed in one vertical plane under a curved horizontal member in a plane at right angles to said first plane, said ribs extending from each of said piers (23) towards said hub (55), said arcuate member further having an outer end section (50) in the vicinity of said hub (55), a terminal member (49) connected to said hub (55), said terminal member (49) having an elongated rectangular flat configuration of a width corresponding substantially to the width of said arcuate member, said terminal member having an inner end coupling piece **(49*a*) bent to lay in a plane alongise said arcuate member so that said terminal member (49)** and said arcuate member extend towards hub in the same plane;

(f) a plurality of roof segments (41) supported by said ribs (15) defining a semi-dome with a curved side and a front side; and, (g) a plurality of flat side panels along said front side extending vertically upwards from said foundation to said defined semi-dome forming an enclosure.

2. A structure as claimed in claim 1, said roof segments (41) being elongated curved tapered segments with side edges having an elongated groove (184) along said side edges, said T-shaped ribs (15) entering grooves of adjacent roof segments.

3. A structure as claimed in claim 2, including U-shaped steel rails (199) interposed between the T-shaped ribs and said grooves (184) said steel rails having an overhanging flange **(199*a*)** partly disposed over said roof segments.

4. A structure as claimed in claim 1, including a hitch (141) attached to said roof support (14); a solar panel (143) with electric solar cells coupled thereto, said solar panel being of generally tapered configuration with an end attached to said hitch said solar panel being generally curved to conform to the shape of the semi-dome; a roller arrangement **(14*a*)** at the base of said panel; an anchor rail extending around said semi-dome at an incline with upper and lower ends; switch means at said ends; drive means coupled to said roller arrangement to drive said panel up said incline to the switch means at the upper end and circuit means coupled between said upper and lower end switch means and said drive means to shut off the drive means when the panel trips the upper end switch means and to restart the drive means when the roller arrangement rolls down the incline and trips and lower end switch means.

5. A structure as claimed in claim 4, including hot air pipes disposed in a heat exchange configuration in said solar panel, hot air storage means in said structure, inflow and outflow pipes between said solar panel and said storage means and hot air outlets coupled to said storage means.

6. A structure as claimed in claim 1, including a roof extension panel extending arcuately over one of said flat side panels defining a closet space and closet walls between said roof extension panel and said side panel, one of said panels serving as a door.

* * * * *